United States Patent [19]

Grimes et al.

[11] Patent Number: 4,592,133

[45] Date of Patent: Jun. 3, 1986

[54] METHOD OF CONSTRUCTING AN ELECTRICAL TRANSFORMER

[75] Inventors: Frank H. Grimes, Athens; Ram R. P. Sinha, Watkinsville, both of Ga.

[73] Assignee: Westinghouse Electric Corp., Pittsburgh, Pa.

[21] Appl. No.: 717,196

[22] Filed: Mar. 28, 1985

[51] Int. Cl.[4] ..... H01F 41/08

[52] U.S. Cl. ..... 29/605; 29/606; 29/609; 242/4 R; 336/223

[58] Field of Search ..... 29/605, 606, 609; 242/4 R, 7.09; 336/222, 223

[56] References Cited

U.S. PATENT DOCUMENTS 3,043,000 7/1962 Hatfield .
3,545,078 12/1970 Lightner .
4,145,804 3/1979 van den Brink .
4,325,045 4/1982 Mehl .
4,337,569 7/1982 Pierce .

*Primary Examiner*—Carl E. Hall

*Attorney, Agent, or Firm*—D. R. Lackey

[57] ABSTRACT

A method of constructing an electrical transformer having an uncut, unjointed magnetic core, which obtains the advantages of cylindrical winding of electrical conductor about the core legs, without the disadvantages of cylindrical winding associated with space factor. The new and improved method includes winding an electrical conductor about a core leg, using cylindrical winding techniques, to provide an electrical winding section having a circular cross-sectional configuration, and then re-forming the winding to a substantially rectangular cross-sectional configuration which minimizes the space occupied by the winding in the core window. This enables cylindrical winding techniques to be used to wind a conductor about another winding leg of the magnetic core. The reforming steps redistribute the winding-core space to a location outside the core window, and in a preferred embodiment of the invention, this space is filled with an auxiliary, jointed magnetic core.

10 Claims, 15 Drawing Figures

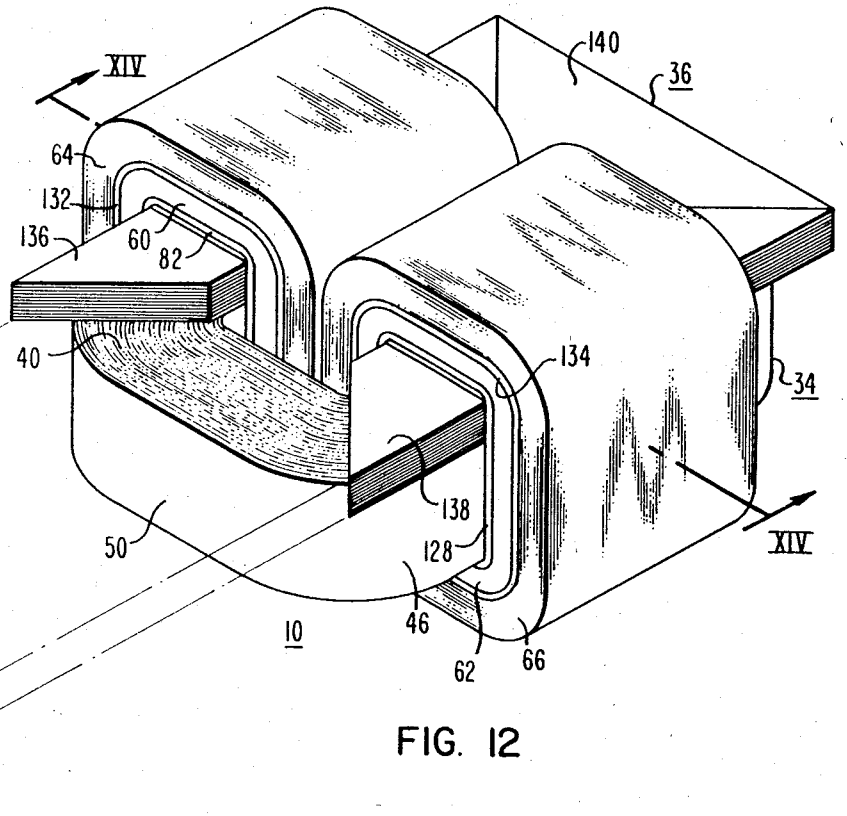
FIG. 12
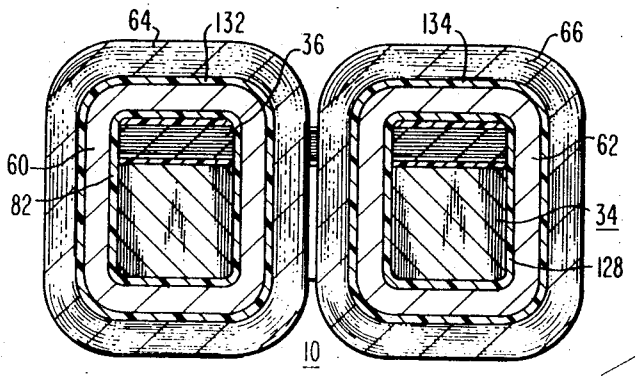
FIG. 14
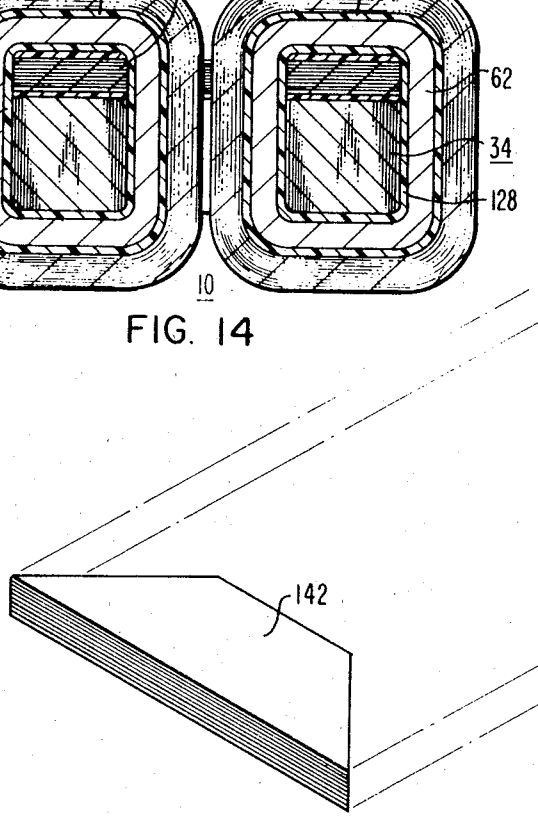

METHOD OF CONSTRUCTING AN ELECTRICAL TRANSFORMER

BACKGROUND OF THE INVENTION

1. Field of the Invention

The invention relates in general to electrical transformers, and more specifically, to new and improved methods of constructing transformers which include an uncut, unjointed magnetic core.

2. Description of the Prior Art

The core losses in the electrical transformers used by electric utility companies represents a significant loss of generated energy, even though transformers are highly efficient. With the increasing value of energy, ways of reducing these losses are constantly being sought. The use of amorphous metal in the magnetic cores of distribution and power transformers appears to be attractive, because, at equivalent inductions, the core losses of electrical grade amorphous metals are only 25% to 35% of the losses of conventional grain-oriented electrical steels.

Amorphous metals, however, in addition to their higher initial cost than conventional electrical steels, also pose many manufacturing problems not associated with conventional electrical steels. For example, amorphous metal is very thin, being only about 1 to 1½mils thick, and it is very brittle, especially after anneal. Thus, with the wound magnetic cores conventionally used with distribution transformers, the core joint becomes a problem, making the use of a jointless magnetic core very attractive. This means that the primary and secondary windings of the transformer must be wound about the magnetic core. Amorphous metal is also very stress sensitive. Any pressure on the magnetic core, or change in its configuration after annealing, will increase its losses.

Thus, it would be desirable to provide new and improved methods for economically manufacturing an electrical transformer having an unjointed, pressure sensitive magnetic core.

SUMMARY OF THE INVENTION

Briefly, the present invention is a new and improved method of constructing an electrical transformer which includes winding a strip of magnetic metallic material, such as amorphous metal, to form an uncut, unjointed magnetic core which includes a core window and leg portions for receiving the electrical windings. The method continues by winding an electrical conductor about a leg portion of the magnetic core to form an inner electrical winding having a circular cross-sectional configuration. The circular cross-sectional configuration of the winding is then re-formed in situ to a substantially rectangular configuration, to minimize the space occupied by the winding in the core window. The increased window space then enables another electrical conductor to be wound about another core leg, also utilizing the advantages of cylindrical winding techniques, to form an inner electrical winding on this leg of the magnetic core. The circular cross-sectional configuration of this electrical winding is then re-formed in situ to a substantially rectangular cross-sectional configuration, to minimize the space occupied by it in the core window. The resulting window space is then adequate to enable the winding of strip or sheet electrical conductor about each re-formed inner winding, to form outer windings which have a cross-sectional configurations which conform with the substantially rectangular cross-sectional configurations of the inner windings. In a preferred embodiment of the invention, a smaller, jointed magnetic core of conventional electrical steel, or of amorphous metal, is assembled about the windings, to fill in the remaining space in the winding openings.

BRIEF DESCRIPTION OF THE DRAWINGS

The invention may be better understood and further advantages and uses thereof more readily apparent when considered in view of the following detailed description of exemplary embodiments, taken with the accompanying drawings in which:

FIG. 12 illustrates a method step which introduces a jointed magnetic core of the stacked type into the winding opening space created at an end of the unjointed magnetic core by the re-forming steps;

FIG. 14 is a cross-sectional view of the transformer shown in FIG. 12, taken between and in the direction of arrows XIV—XIV.

DESCRIPTION OF THE PREFERRED EMBODIMENTS

Figure 1:
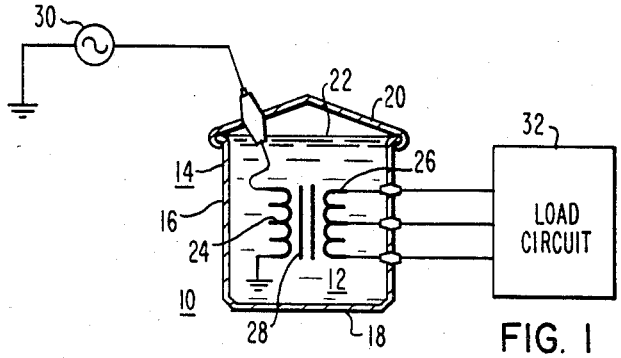
FIG. 1 is a partially schematic diagram of an electrical transformer which may be constructed according to the teachings of the invention.

Referring now to the drawings and to FIG. 1 in particular, there is shown an electrical transformer 10 of the distribution type, which may be constructed according to the teachings of the invention. Transformer 10 includes a core-coil assembly 12 disposed in a tank 14 having side wall, bottom and cover portions 16, 18 and 20, respectively. The core-coil assembly 12 is immersed in a liquid cooling dielectric 22, such as mineral oil. The coil portion of assembly 12 includes primary and secondary windings 24 and 26, respectively, which are disposed in inductive relation with a magnetic core 28. The primary winding 24 is adapted for connection to a source 30 of electrical potential, and the secondary winding 26 is adapted for connection to a load circuit 32.

Figure 2:
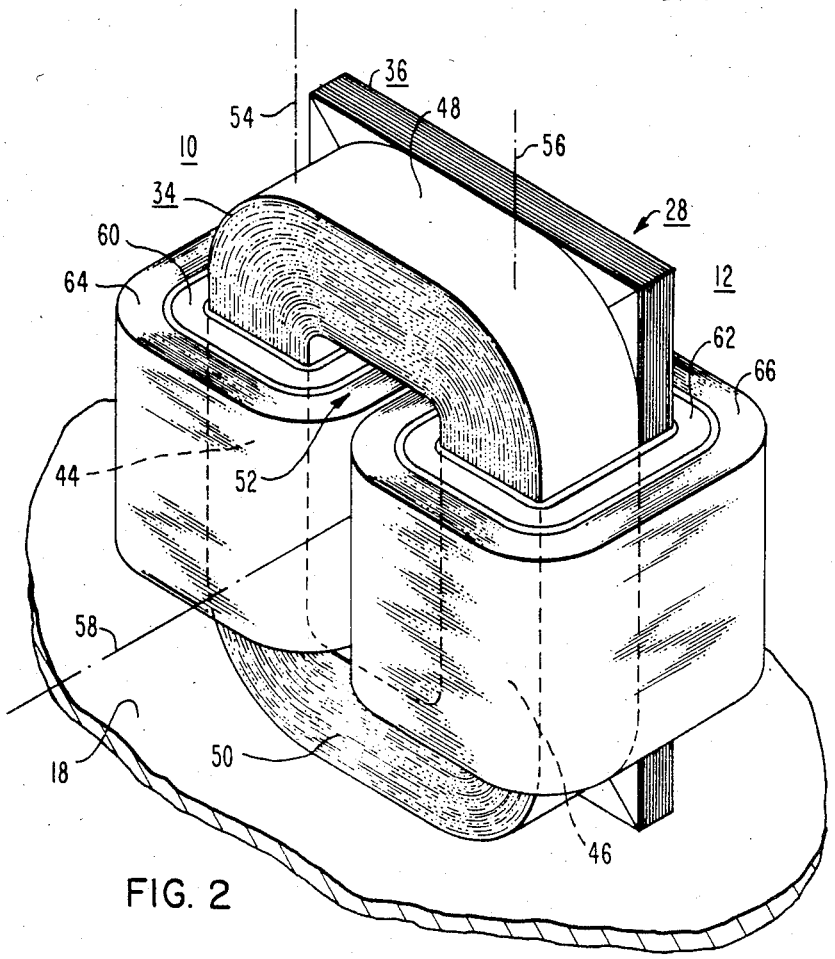
FIG. 2 is a perspective view of a core-form, core-coil assembly of an electrical transformer which may be constructed according to the teachings of the invention.
Figure 2A:
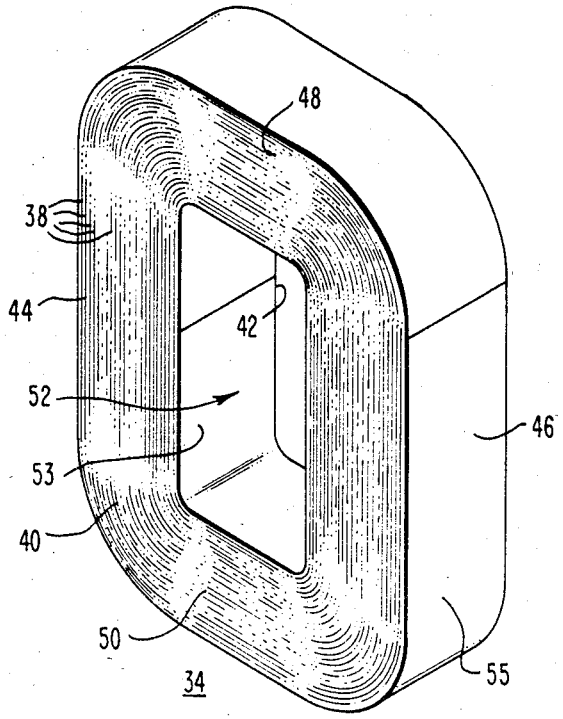
FIG. 2A is a perspective view of the main magnetic core shown in the core-coil assembly of FIG. 2.

As shown in FIG. 2, which is a perspective view of a core-form embodiment of the core-coil assembly 12 shown schematically in FIG. 1, the magnetic core 28, in a preferred embodiment of the invention, includes a main magnetic core 34 and an auxiliary magnetic core 36. The main magnetic core 34 is a wound, uncut, unjointed core formed of a thin elongated sheet of ferromagnetic material, preferably amorphous metal, such as Allied Corporation's 2605SC, which is wound to provide a plurality of closely-adjacent nested lamination turns 38. The closely adjacent edges of the lamination turns 38 collectively form first and second flat opposite sides or ends 40 and 42, respectively, of magnetic core 34. The lamination turns 38 also define a substantially rectangular configuration which collectively form first and second spaced, parallel, winding leg portions 44 and 46, respectively, joined by upper and lower yoke portions 48 and 50, respectively. The winding leg and yoke portions, which are rectangular in cross section, define an opening or core window 52. The innermost and outermost lamination turns of the magnetic core define inner and outer surfaces 53 and 55, respectively, of the main magnetic core 34.

The main magnetic core 34 is wound round and reshaped, or it may be wound on a mandrel having a rectangularly-shaped male portion. It is then annealed to remove stresses and optimize its magnetic properties, while it is maintained in a rectangular configuration.

Figure 11:
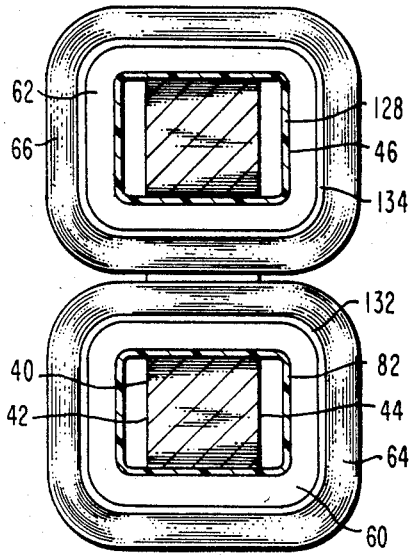
FIG. 11 illustrates the step of forming an outer electrical winding on the remaining re-formed inner electrical winding, to substantially completely fill the window space between the two winding legs of the magnetic core with electrical conductors of the inner and outer electrical windings.
Figure 13:
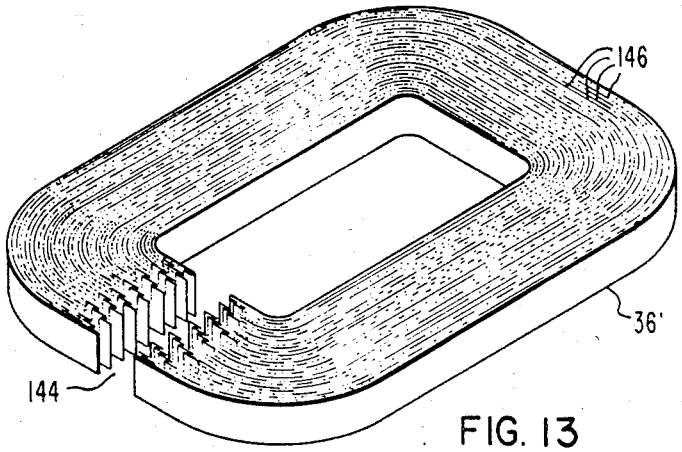
FIG. 13 illustrates a wound, jointed magnetic core which may be used in place of the stacked magnetic core shown in FIG. 12.

The auxiliary magnetic core 36, which is placed against end 42 of the main magnetic core 34, includes at least one joint and it may be of the stacked type shown in FIGS. 2, 11 and 12 or of the wound type shown in FIG. 13. If it is of of the stacked type it may be constructed of amorphous metal, or of conventional grain oriented electrical steel, as desired. If it is of the wound type, it would most likely be constructed of conventional grain oriented electrical steel because the joint would make it difficult to construct the core, and because the stresses applied to the core during manufacturing and assembly would adversely affect its losses.

FIG. 2 illustrates transformer 10 with core-coil assembly 12 in a preferred operating position, with the magnetic core 28 being oriented with the longitudinal axes 54 and 56 of the winding legs 44 and 46, respectively, orthogonal to the tank bottom 18, which results in the center line 58 of core window 52 being horizontally disposed. In the rectangular core-form construction of the preferred embodiment, the primary or high voltage winding 24 and the secondary or low voltage winding 26 are divided into electrically interconnected sections, such as sections 60 and 62 of the primary winding 24, and sections 64 and 66 of the secondary winding 26. Sections 60 and 64 are concentrically disposed on winding leg 44, and sections 62 and 66 are concentrically disposed on winding leg 46. The primary winding sections 60 and 62, which are formed of insulated copper or aluminum wire, form the inner winding sections, and the secondary sections 64 and 66, which are preferably formed of insulated copper or aluminum sheet or strip, form the outer winding sections of the concentric relationships.

Figure 3:
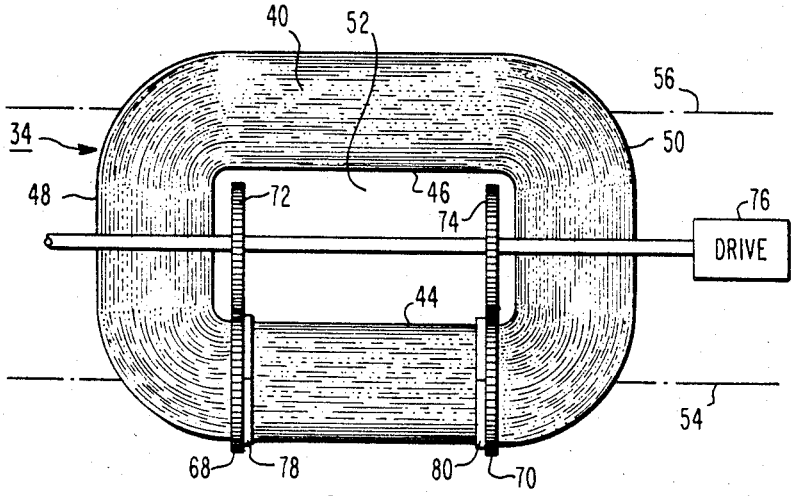
FIG. 3 illustrates a first step in a method of constructing a cylindrical electrical winding about the winding leg of a wound, uncut, unjointed, magnetic core, which may be formed of pressure sensitive amorphous metal.
Figure 4:
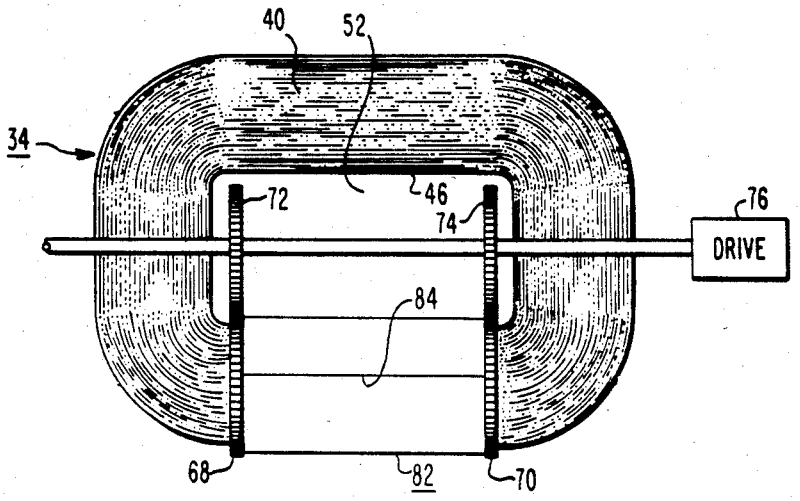
FIG. 4 illustrates the step of forming a cylindrical insulative support for the electrical winding, which support also functions to protect the pressure sensitive core from winding stresses, and as ground insulation for the electrical winding.
Figure 5:
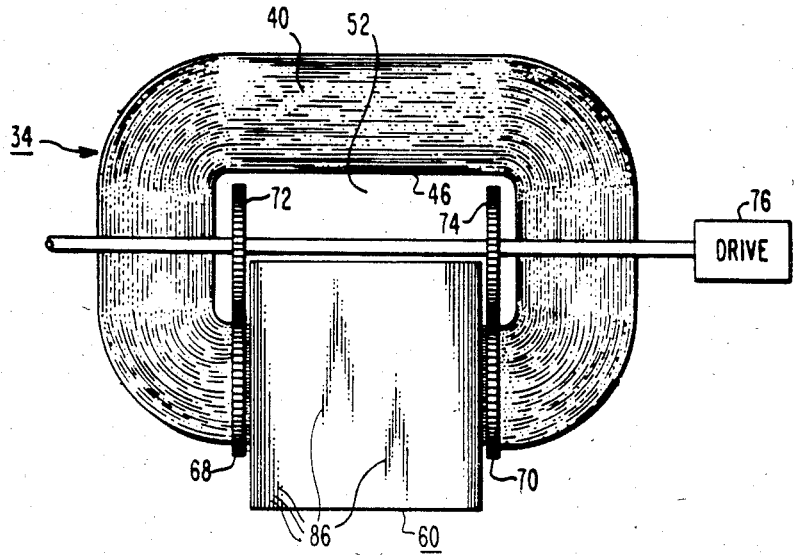
FIG. 5 illustrates the step of winding insulated electrical conductor, such as wire, about the insulative support formed in the step of FIG. 4, to form an inner electrical winding which initially has a circular cross-sectional configuration.

FIG. 3 illustrates a first step in the new and improved method of constructing transformer 10, which involves winding cylindrical winding section 60 about winding leg 44 of the closed magnetic core loop 34. The method of forming winding section 60, for example, may include the steps of assembling arcuate sections of split gears 68 and 70 about winding leg 44, which gears, when assembled, are spaced apart on winding leg 44 and supported for rotation at appropriate points by support wheels. Certain of the support wheels are in the form of pinion gears which are engaged with the split gears, such as pinion gears 72 and 74 shown in FIG. 3, which engage split gears 68 and 70, respectively. Pinion gears 72 and 74 are driven by a drive shaft and suitable drive means 76. The split gears 68 and 70 include suitable flanges 78 and 80, respectively, upon which a tubular insulative member is formed. For example, an elongated sheet of insulating material, such as cellulosic insulation having a B-staged adhesive pattern disposed on one or both sides, as disclosed in U.S. Pat. No. 3,246,271, may be used. One end of the insulative sheet is attached to the flanges 78 and 80, and, while the gears 68 and 70 are rotated, the insulative sheet is wound on the flanges until a predetermined build dimension is achieved which has the desired mechanical support strength as well as the required electrical breakdown strength. The electrical breakdown strength of the resulting tubular insulative member 82, shown in FIG. 4, is especially important, because the tubular insulative member 82 will provide the electrical ground insulation for the windings on core leg 44 during the operation of transformer 10. The trailing end 84 of the insulative sheet material used to form the insulative member 82 is suitably secured to prevent it from unwinding, and the method is ready for the next step, which is shown in FIG. 5. Subsequent processing of the magnetic core and transformer which involves the use of heat, will advance the B-staged adhesive to final cure, which will tenaciously bound the turns of the insulative member to form a cohesive high strength structure.

In the step shown in FIG. 5, the first primary or high voltage winding section 60 is formed. For example, an insulated electrically conductive wire is suitably fixed to the insulative member 82, with the end of the wire extending outwardly along the side of one of the gears 68 or 70. The gears 68 and 70 are then driven to pull the wire from its reel, to form a first winding layer about tubular insulative member 82. The winding layer includes a plurality of closely-spaced helical conductor turns which extend from one gear to the other. A sheet of layer insulation, such as a sheet of the same material of which the tubular insulative member 82 is formed, is then placed into position such that the winding of the next layer of conductor turns will secure the layer insulation tightly between the winding layers. This process is continued, adding layers of conductor turns and layer insulation. Certain sheets of layer insulation may have duct forming members attached thereto, such at duct sticks, as required to create coolant ducts through the winding section 60 for heat removing flow of the coolant 22 through the winding section 60 during the operation of transformer 10. When the desired number of layers of conductor turns has been completed, the end of the wire of the outermost layer of conductor turns 86 is suitably secured to the side of a gear, with both ends of the wire being sufficiently long to make the requisite electrical connections between winding sections and to the terminals or bushings, as shown in FIG. 1. The electrical connections will be made after all of the winding sections have been completed.

Figure 6:
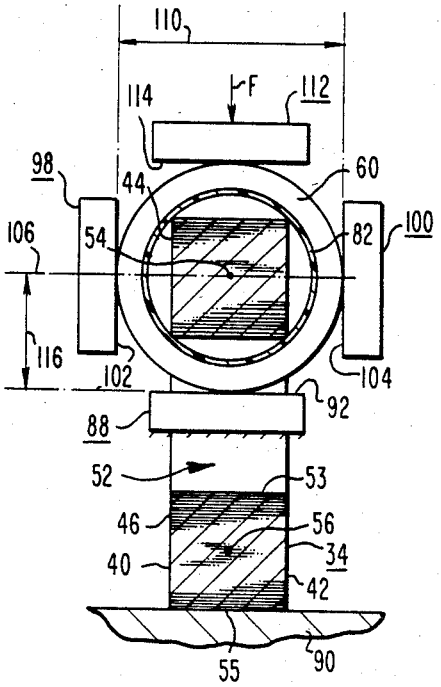
FIG. 6 illustrates a first step in a method of re-forming or changing the circular cross-sectional configuration of the first inner electrical winding in situ to a substantially rectangular configuration, which minimizes the space occupied by the winding in the core window, measured in a direction between the associated winding leg and the parallel winding leg on the other side of the core window.

The arcuate sections which make up split gears 68 and 70 are disassembled and removed, and the winding section 60, along with the tubular insulative member 82, are ready for the next steps, which include changing or re-forming their cross-sectional configurations from circular to rectangular. As shown in FIG. 6, which is a cross-sectional view through magnetic core 24, taken adjacent to one end of winding section 60, a forming support 80 for winding section 60 is disposed through the core window 52. At this point, the weight of magnetic core 34 may also be supported by a suitable support 90. A flat support surface 92 of winding forming support 88 is oriented perpendicular to a line which extends between the longitudinal axes 54 and 56 of winding legs 44 and 46, respectively. Winding support 88 is fixed in its position.

First and second lateral winding forming members 98 and 100 having flat surfaces 102 and 104, respectively, are disposed on opposite sides of winding section 60, each disposed 90 degrees from the location of the fixed forming support 88. In other words, a line 106 through longitudinal axis 54 of winding leg 44 which is parallel to flat surface 92 of support 88, would be perpendicular to the flat surfaces 102 and 104 of the lateral forming members 98 and 100. The lateral forming members 98 and 100 are adjusted to provide equal dimensions on opposite sides of longitudinal axis 54, until a predetermined total dimension 110 between surfaces 102 and 104 is achieved. While winding section 60 is shown with a round configuration in FIG. 6, after the desired dimension 110 is achieved, in actual practice winding section 60 may be slightly egg shaped, depending upon the relative dimensions of the core build and the thickness of the winding section 60. While dimension or spacing 110 is fixed once it is achieved, it is important that the lateral forming members 98 and 100 be free to move towards the fixed forming support 88 as the winding cross section is being re-formed from circular to rectangular.

Figure 7:
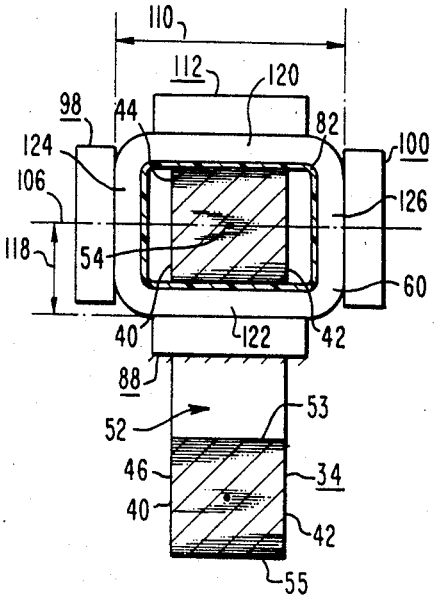
FIG. 7 illustrates the first inner electrical winding after being reshaped by the method step of FIG. 6.

A final winding forming member 112 having a flat surface 114 is disposed on the remaining side of winding section 60, with flat surface 114 being parallel with the flat surface 92 of the fixed support 88. Forming member 112 is advanced towards fixed member 88 with a force F. The core support 90 may either be removed, or allowed to move with the magnetic core, during the re-forming step, as desired. It will be noted in FIG. 6 that the distance 116 between the longitudinal axis 54 and surface 92 becomes a shorter distance 118 in FIG. 7, after re-forming, and that the lateral forming members 98 and 100, while still spaced by the same dimension 110 have moved with the core 34 during forming, such that line 106 through longitudinal axis 54 still intersects the longitudinal midpoints of the lateral forming members 98 and 100, as in the FIG. 6 position. It will be noted in FIG. 7 that the re-formed winding section 60 and the tubular insulative member 82 have four flat sides or legs 120, 122, 124 and 126 formed by forming members 112, 88, 98 and 100, respectively, and that the extension of winding 60 into window 62 is minimized by making winding side 122, and the opposite parallel winding side 120, conform closely to the inner and outer surfaces, respectively, of the magnetic core 34. In other words, the ground insulation formed by tubular insulative member 82 associated with winding sides 122 and 120 lightly contacts the inner and outer surfaces 53 and 55, respectively, of the magnetic core 34, while the tubular insulative member 82 associated with the remaining winding sides 124 and 126 is spaced away from the flat ends 40 and 42 of magnetic core 34. Thus, the coil dimension within the core window 52, in a direction between the winding legs 44 and 46 is minimized, with little or no space between the core and winding. All excess space is relocated outside the core window 52. It should also be noted that the re-forming step takes place without introducing any forming members within the winding openings, eliminating the possibility of damaging the conductor turns, their insulative coatings, or the insulative tubular member which forms the ground insulation. By allowing the lateral forming members 98 and 100 to move with the winding and core as the winding is being reformed, the corners automatically square up without the necessity of introducing internal forming members.

Figure 8:
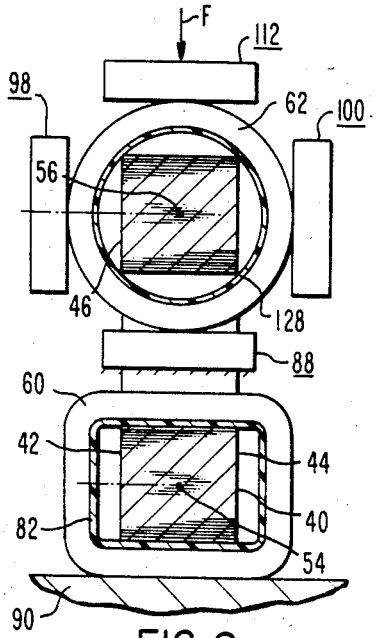
FIG. 8 illustrates an inner electrical winding formed on the remaining core leg, which is initially wound cylindrical in a manner similar to the other inner electrical winding, and which is ready to be re-formed.
Figure 9:
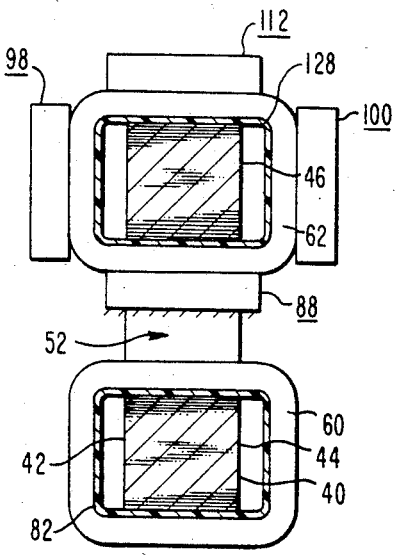
FIG. 9 illustrates the cylindrical winding shown in FIG. 8, after the re-forming step.

The advantages of cylindrical winding have been achieved relative to winding section 60, which advantages include the constant wire tension and high speed aspects of cylindrical winding, as well as the fact that no winding stresses have been applied to the magnetic core during winding. The reforming step removes the disadvantages of cylindrical winding by minimizing the winding space occupied by winding section within the core window 52. The additional space within the core window provided by the re-forming step now provides space for repeating the method steps shown in FIGS. 3, 4 and 5 relative to winding leg 46. As shown in FIG. 8, a tubular insulative member 128 is formed about leg 46 of magneitc core 34, and the primary or high voltage winding section 62 is wound about it, exactly as hereinbefore described relative to winding section 60. Winding section 62 is then placed within the forming members 88, 98, 100 and 112, as shown in FIG. 8 and described relative to FIG. 6, and winding section 62 and its insulative support member 128 are reformed, as shown in FIG. 9.

Figure 10:
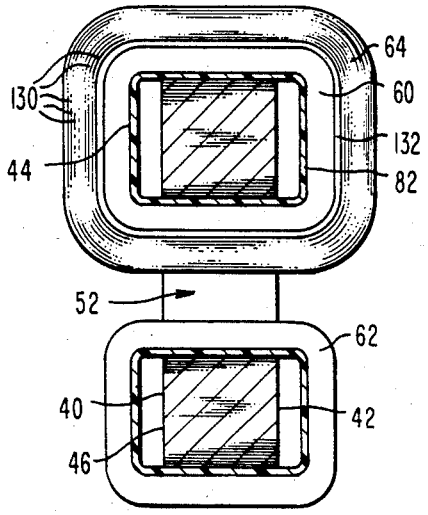
FIG. 10 illustrates the step of forming an outer electrical winding on one of the re-formed inner electrical windings, preferably using strip or sheet conductor.

Since the dimensions of both high voltage winding sections 60 and 62 have been minimized within the core window 52, there is now space within window 52 for winding the low voltage winding section 64, shown in FIG. 10, about the high voltage winding section 60. The low voltage winding section 64 carries substantially more current than the high voltage winding section 60, and thus the conductor from from which it is formed must be substantially greater in cross-sectional area. Thus it has sufficient mechanical support and rigidity in and of itself to permit the leading end of the conductor to be advanced through the core window 52 without the need for split gears or for guide means extending through the window opening. In a preferred embodiment of the invention, secondary winding section 64 is formed of insulated copper or aluminum sheet or strip which is wound about the high voltage winding 60 to provide a plurality of superposed conductor turns 130, each of which has a substantially rectangular cross-sectional configuration to closely conform the low voltage winding section 64 with the rectangular cross-sectional configuration of the re-formed high voltage winding section 60. The width of the conductor turns 130 of the low voltage section 64 may be selected such that the low voltage winding section 64 is formed from a single strip; or, more than one strip may be used to provide part coils which are electrically interconnected to form winding section 64, as desired. As shown in FIG. 11, the remaining low voltage winding section 66 is formed about the high voltage winding section 62, with winding section 66 substantially completely filling the core window 52 in the direction between the core legs 44 and 46. Also, as shown in FIGS. 10 and 11, before each low voltage winding section is wound, an insulative strip, which may be the same type of material used to form the ground insulation, i.e., insulative members 82 and 128, is wound about each high voltage winding section to form insulative structures 132 and 134 which function as the high-low insulation between the concentric winding sections. Winding methods and apparatus suitable for winding the low voltage winding sections 64 and 66 from insulated aluminum or copper strip are disclosed in copending Application Ser. No. 527,601, filed Aug. 29, 1983, entitled "Strip Coil Winder for Core-Coil Assembly", which application is assigned to the assignee as the present application. In order to limit the length of the present application, this co-pending application is hereby incorporated into the specification of the present application by reference.

Since the core factor within the winding openings is imortant, as the conductor factor is important within the core opening 52, in a preferred embodiment of the invention the space between the ends of core 34 and the inside of the insulative members 82 and 128 is filled with an auxiliary core member 36 which has at least one joint. While the space at each end 40 and 42 may be filled with a separate auxiliary magnetic core, it is preferable to move the main magnetic core 34 off center, with one core end located as closely as possible to the ground insulation. The remaining larger space is then filled with the auxiliary magnetic core 36. As shown in FIGS. 2, 12 and 14, auxiliary core member 36 may be a magnetic core of the stacked type having spaced leg portions 136 and 138 which extend through the insulative members 82 and 128, respectively, adjacent to core end 40, or the opposite core end, as desired. Upper and lower yoke portions 140 and 142 complete the magnetic core loop. Auxiliary magnetic core 36, in a preferred embodiment of the invention, is formed of grain oriented electrical steel, such as cold rolled silicon steel having a thickness dimension of 7 to 14 mils, and as such, the laminations of each layer, which include a lamination from each leg and yoke, preferably have mitered ends. The mitered joints formed between the mitered ends are preferably offset from one another, from layer to layer, in either a butt-lap or stepped-lap joint, to minimize joint losses at the four corner joints. U.S. Pat. No. 3,153,215 discloses examples of typical stepped-lap stacked core construction. With a stacked type magnetic core, it would also be practical to use amorphous metal to form the auxiliary core 36, in which event the ends of each lamination need not be mitered. The four joints of each lamination layer may simply be formed from four I-shaped plates or laminations.

Auxiliary magnetic core 36 may also be a jointed, wound magnetic core, an example of which is shown in FIG. 13 and referenced 36'. Magnetic core 36' has one or more joints, such as joint 144, which enables magnetic core 36' to be assembled through the winding openings, and the joint subsequently closed. U.S. Pat. No. 2,973,494 discloses examples of typical wound core jointed construction which may be used. Since wound amorphous metal cores with one or more openable joints are difficult to manufacture economically, the lamination turns 146 of the wound auxiliary magnetic core 36' are preferably formed of grain oriented electrical steel.

FIG. 14 is a cross-sectional view of transformer 10 shown in FIG. 12, taken between and in the direction of arrows XIV—XIV. It will be noted that the core space factor within the winding openings has been substantially increased with the addition of the auxiliary magnetic core 36.

In summary, there has been disclosed new and improved methods of constructing an electrical transformer which enables cylindrical winding techniques to be used for the high voltage winding sections about an uncut, unjointed magnetic core, notwithstanding that each winding leg of the magnetic core has a square or rectangular cross-sectional configuration. Each high voltage winding section is wound to a circular cross-sectional configuration and then re-formed to a rectangular configuration, which minimizes the space occupied by the high voltage winding section within the core window between the winding legs. This space enables the low voltage winding section to be wound about the high voltage winding sections, and to closely conform them to the rectangular configurations of the high voltage winding sections. In a preferred embodiment, the space in the winding openings between the windings and the core, which has been redistributed to form outside the core window, is filled with an auxiliary jointed magnetic core.

Thus, the disclosed methods enjoy the advantages of cylindrical winding, without the disadvantages. In other words, it allows constant tension to be maintained in the wire as the high voltage winding sections are being wound, which enables a much higher speed winding process than when winding about a rectangular form. The cylindrical winding technique also prevents winding stresses from being applied to the stress sensitive magnetic core, which is preferably formed of low-loss amorphous metal. If a rectangularly-shaped coil were to be wound directly upon the rectangular winding leg, the core stresses induced by the winding steps would increase as the coil build grows.

The disclosed method saves magnetic core material, disclosing techniques which result in improved core and coil space factors. With poorer space factors, the magnetic core has to be physically larger, which increases the physical size of the electrical windings and the physical size of the tank, which in turn requires more liquid dielectric.

The disclosed methods, wherein the magnetic core is free to move during the re-forming step of the high voltage winding sections also prevents stressing the magnetic core beyond its elastic limit. If support 90 is removed during forming, the only stresses on the magnetic core are due to gravity, and even these small stresses may be eliminated by moving the support 90 with the magnetic core, as the magnetic core moves during the re-forming step. It is also important that the disclosed forming steps apply no forces to the magnetic core from inside the winding, so there is no possibility of damaging the windings and associated electrical insulation.

We claim as our invention:

1. A method of constructing an electrical transformer, comprising the steps of:

winding a magnetic core from an elongated strip of metallic magnetic material to form a closed, unjointed loop having first and second ends, first and second leg portions each having a rectangular cross-sectional configuration, adjoining yoke portions, an outer surface defined by said leg and yoke portions, and a core window which defines an inner core surface;

winding an electrical conductor about the first leg portion to form a first electrical winding having an opening which defines a circular cross-sectional configuration;

changing the circular cross-sectional configuration of said first electrical winding into a substantially rectangular configuration having winding portions which are closely adjacent to an inner core surface;

winding an electrical conductor about the second leg portion to form a second electrical winding having an opening which defines a circular cross-sectional configuration;

changing the circular cross-sectional configuration of said second electrical winding into a substantially rectangular configuration having winding portions which are closely adjacent to an inner core surface;

winding an electrical conductor about the reformed first electrical winding to form a third electrical winding having a substantially rectangular cross-sectional configuration;

and winding an electrical conductor about the reformed second electrical winding to form a fourth electrical winding having a substantially rectangular cross-sectional configuration.

2. The method of claim 1 wherein each step of winding an electrical conductor about a leg portion of the magnetic core to form the first and second electrical windings is preceded by the step of constructing an insulative support for the associated electrical winding about the leg portion, with said insulative support having a circular cross-sectional configuration, and wherein each step of changing the circular cross-sectional configuration of an electrical winding to a substantially rectangular cross-sectional configuration also changes the circular cross section of the associated insulative support to a substantially rectangular cross-sectional configuration.

3. The method of claim 2 wherein the steps of winding an electrical conductor about the first and second electrical windings are each preceded by the step of constructing an insulative barrier member about the associated electrical winding which has a substantially rectangular cross-sectional configuration, conforming with the rectangular cross-sectional configuration of the associated inner winding.

4. The method of claim 1 wherein the steps of changing the circular cross-sectional configuration of the first and second electrical windings creates a space in the winding openings outside the window of the unjointed magnetic core, and including the step of filling at least part of the space with magnetic metallic material.

5. The method of claim 1 wherein the step of changing the circular cross-sectional configuration of the first and second electrical windings creates spaces in the winding openings between the innermost surfaces of the changed configurations and the magnetic core, outside the core window, and including the step of linking the first, second, third and fourth electrical windings with a second magnetic core having at least one openable joint therein which magnetic core substantially fills the space in the winding openings created by the steps of changing the cross-sectional configurations of the first and second electrical windings to substantially rectangular cross-sectional configurations.

6. The method of claim 1 wherein the step of winding a magnetic core from an elongated strip of metallic material utilizes amorphous metal, and the steps of changing the circular cross-sectional configurations of the first and second electrical windings creates spaces in the winding openings outside the window of the unjointed magnetic core, and including the step of constructing a second magnetic core, having at least one openable joint, from grain oriented electrical steel, and assembling said second magnetic core to form a complete magnetic circuit which links the first, second, third and fourth electrical windings, while at least partially filling the spaces in the winding openings.

7. The method of claim 1 wherein the steps of changing the cross-sectional configurations of the first and second electrical windings creates spaces in the winding openings adjacent to two opposite portions of the unjointed magnetic core, and including the steps of moving the magnetic core in the winding opening such that substantially all of the space is distributed to one location, and filling said space with an auxiliary, jointed magnetic core.

8. The method of claim 1 wherein each of the steps of changing the circular cross-sectional configurations of the first and second electrical windings includes the steps of:

forcing a first flat surface against one side of the winding, to press the opposite side against a fixed second flat surface, while simultaneously flattening the lateral sides, as the winding elongates against third and fourth flat surfaces which have a fixed spacing, but which are free to move in the direction of the force applied to the first flat surface.

9. The method of claim 2 wherein the step of constructing each insulative support includes the step of winding an elongated strip of insulative material about the associated leg portion of the magnetic core to form an insulative winding tube having a plurality of superposed layers.

10. The method of claim 1 wherein the step of winding the first and second electrical windings utilizes wire conductor having a plurality of conductor turns per layer, and the steps of winding the third and fourth electrical windings utilize strip electrical conductor having a single turn per winding layer.

* * * * *